US009875679B2

(12) United States Patent
Chen et al.

(10) Patent No.: US 9,875,679 B2
(45) Date of Patent: Jan. 23, 2018

(54) GAMMA CURVE ADJUSTING METHOD AND DEVICE

(71) Applicant: BOE TECHNOLOGY GROUP CO., LTD., Beijing (CN)

(72) Inventors: Yi Chen, Beijing (CN); Guangcai Yuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/160,572

(22) Filed: May 20, 2016

(65) Prior Publication Data

US 2017/0046995 A1 Feb. 16, 2017

(30) Foreign Application Priority Data

Aug. 14, 2015 (CN) ..... 2015 1 0501990

(51) Int. Cl.
*G09G 5/10* (2006.01)
*G09G 3/20* (2006.01)

(52) U.S. Cl.
CPC ... *G09G 3/2003* (2013.01); *G09G 2320/0233* (2013.01); *G09G 2320/0271* (2013.01); *G09G 2320/0673* (2013.01); *G09G 2360/16* (2013.01)

(58) Field of Classification Search
CPC ..... G09G 3/2003; G09G 3/006; G06T 5/00
See application file for complete search history.

(56) References Cited

U.S. PATENT DOCUMENTS

2008/0158240 A1 7/2008 Huang et al.
2012/0120124 A1* 5/2012 Zhang ..... G09G 3/3648 345/690
2016/0189347 A1* 6/2016 Hu ..... G06T 5/00 345/589

FOREIGN PATENT DOCUMENTS

CN 1777294 A 5/2006
CN 1929624 A 3/2007
(Continued)

OTHER PUBLICATIONS

First Office Action dated Mar. 28, 2017 corresponding to Chinese application No. 201510501990.1.

*Primary Examiner* — Phi Hoang
(74) *Attorney, Agent, or Firm* — Nath, Goldberg & Meyer; Joshua B. Goldberg; Annie J. Kock

(57) ABSTRACT

The present disclosure provides gamma curve adjusting method and device, and the method includes: substituting a preset maximum brightness value, a preset gamma value and gray-scale values into a standard gamma curve calculation formula, to obtain brightness values corresponding to the gray-scale values; selecting N gray-scale values from the gray-scale values, and actually measuring, in the condition of the selected N gray-scale values, gray-scale voltage values required to reach brightness values, respectively corresponding to the selected N gray-scale values, calculated according to the standard gamma curve calculation formula, where N is a positive integer; obtaining a function formula between gray-scale voltage value and brightness value according to brightness values respectively corresponding to the selected N gray-scale values and the actually measured gray-scale voltage values; and calculating gray-scale voltage values corresponding to brightness values smaller than or equal to the preset maximum brightness value, according to the obtained function formula.

9 Claims, 3 Drawing Sheets

(56) References Cited

FOREIGN PATENT DOCUMENTS

| | | | |
|---|---|---|---|
| CN | 101071536 | A | 11/2007 |
| CN | 101211035 | A | 7/2008 |
| CN | 102369565 | A | 3/2012 |
| CN | 103413513 | A | 11/2013 |
| CN | 104123926 | A | 10/2014 |

* cited by examiner

GAMMA CURVE ADJUSTING METHOD AND DEVICE

FIELD OF THE INVENTION

The present invention relates to the field of display technology, and particularly to a gamma curve adjusting method and a gamma curve adjusting device.

BACKGROUND OF THE INVENTION

Every display product has a gamma value. In terms of white organic light emitting diode (WOLED) display panels, the gamma value of each display panel may vary as color coordinates or electroluminescent efficiency thereof varies. Moreover, as the usage time of the display panel increases, an electroluminescent device is aged, and electroluminescent efficiency thereof decreases accordingly, thereby resulting in a change in the gamma value.

Currently, a large-size light emitting diode display panel generally has a structure in which a white light emitting diode cooperates with a color filter. White balancing is needed before adjusting the gamma value, and the gamma value for each of red (R), green (G), blue (B), and white (W) colors needs to be adjusted separately.

At present, gamma curve adjustment is achieved by actually measuring voltage values required when each of nine points with known gray-scales (specified by IC spec) reaches a desired brightness corresponding thereto. Therefore, for each display panel, it is necessary to measure gray-scale voltage values of 36 (=(RGBW)4*9) points in total. In addition, in order to cope with changes in data voltage, multiple groups of gamma values may need to be set before a light emitting diode display panel leaves the factory, for example. Gamma2 (i.e., gamma value of 2), Gamma2.2 (i.e., gamma value of 2.2). Gamma2.4 (i.e., gamma value of 2.4) and the like are set for each of brightness of 100 nit and brightness of 150 nit. For each group of gamma values, 36 points need to be measured, and thus it takes a lot of time to test multiple groups of gamma values, which makes it difficult to meet the deadlines of mass production.

SUMMARY OF THE INVENTION

An object of the present invention is to provide a gamma curve adjusting method and a gamma curve adjusting device to adjust gamma curve quickly.

In order to achieve the above object, as a first aspect of the present invention, there is provided a gamma curve adjusting method, including steps of:

substituting a preset maximum brightness value, a preset gamma value and gray-scale values into a standard gamma curve calculation formula, to obtain brightness values corresponding to the gray-scale values;

selecting N gray-scale values from the gray-scale values, and actually measuring, in the condition of the selected N gray-scale values, gray-scale voltage values required to reach brightness values, respectively corresponding to the selected N gray-scale values, calculated according to the standard gamma curve calculation formula, where N is a positive integer;

obtaining a function formula between gray-scale voltage value and brightness value according to the brightness values respectively corresponding to the selected N gray-scale values and the actually measured gray-scale voltage values; and calculating the gray-scale voltage values corresponding to brightness values smaller than or equal to the preset maximum brightness value, according to the obtained function formula.

Optionally, the standard gamma curve calculation formula is:

$$L_{Gray} = L_{max}\left(\frac{\text{Gray}}{N_{Gray_max}}\right)^{\gamma};$$

where, $N_{gray_max}$ is the maximum gray-scale value, Gray is any gray-scale value in the range of $[0, N_{gray_max}]$, $\gamma$ is the preset gamma value, $L_{max}$ is the preset maximum brightness value, and $L_{Gray}$ is the brightness value corresponding to the gray-scale value Gray.

Optionally, the step of obtaining a function formula between gray-scale voltage value and brightness value according to the brightness values respectively corresponding to the selected N gray-scale values and the actually measured gray-scale voltage values includes:

sequentially selecting two adjacent gray-scale values from the N selected gray-scale values and performing spline fitting on the brightness values and the gray-scale voltage values corresponding to the two adjacent gray-scale values, to obtain (N−1) function formulas; and the step of calculating the gray-scale voltage values corresponding to brightness values smaller than or equal to the preset maximum brightness value, according to the obtained function formula includes:

calculating the gray-scale voltage values corresponding to the brightness values between two brightness values respectively corresponding to the two adjacent gray-scale values, according to the function formula obtained by performing spline fitting on the brightness values and the gray-scale voltage values corresponding to the two adjacent gray-scale values.

Optionally, the (N−1) function formulas each are a cubic function formula, and the cubic function formula obtained by performing fitting on the brightness values and the gray-scale voltage values corresponding to the n-th selected gray-scale value and the (n+1)-th selected gray-scale value is:

$$V=a_{1n}(L-L_n)^3+a_{2n}(L-L_n)^2+a_{3n}(L-L_n)+V_n;$$

where, $n\in[1, N-1]$, L is a brightness value in the range of $[L_n, L_{n+1}]$, $L_n$ is the brightness value corresponding to the n-th selected gray-scale value, $L_{n+1}$ is the brightness value corresponding to the (n+1)-th selected gray-scale value, $V_n$ is the gray-scale voltage value corresponding to the brightness value $L_n$, V is the gray-scale voltage value corresponding to the brightness value L, and $a_{1n}$, $a_{2n}$ and $a_{3n}$ are fitting coefficients; and as for the brightness value in the range of $[L_n, L_{n+1}]$, the gray-scale voltage value corresponding thereto is calculated according to the cubic function formula.

Optionally, $N\geq 9$.

Optionally, N=9;

the cubic function formula obtained by performing fitting on the brightness values and the gray-scale voltage values corresponding to the first and second selected gray-scale values is:

$$V=a_{11}(L-L_1)^3+a_{21}(L-L_1)^2+a_{31}(L-L_1)+V_1 \quad (1\text{-}1)$$

as for the brightness value L in the range of $[L_1, L_2]$, the gray-scale voltage value V corresponding thereto is calculated according to the cubic function formula (1-1), where $L_1$ and $L_2$ are the brightness values corresponding to the first and second selected gray-scale values, respectively, $V_1$ is the gray-scale voltage value corresponding to the first selected gray-scale value, and $a_{11}$, $a_{21}$ and $a_{31}$ are fitting coefficients of the cubic function formula (1-1);

the cubic function formula obtained by performing fitting on the brightness values and the gray-scale voltage values corresponding to the second and third selected gray-scale values is:

$$V=a_{12}(L-L_2)^3+a_{22}(L-L)^2+a_{32}(L-L_2)+V_2 \quad (1\text{-}2)$$

as for the brightness value L in the range of $[L_2, L_3]$, the gray-scale voltage value V corresponding thereto is calculated according to the cubic function formula (1-2), where $L_2$ and $L_3$ are the brightness values corresponding to the second and third selected gray-scale values, respectively, $V_2$ is the gray-scale voltage value corresponding to the second selected gray-scale value, and $a_{12}$, $a_{22}$ and $a_{32}$ are fitting coefficients of the cubic function formula (1-2);

the cubic function formula obtained by performing fitting on the brightness values and the gray-scale voltage values corresponding to the third and fourth selected gray-scale values is:

$$V=a_{13}(L-L_3)^3+a_{23}(L-L_3)^2+a_{33}(L-L_3)+V_3 \quad (1\text{-}3)$$

as for the brightness value L in the range of $[L_3, L_4]$, the gray-scale voltage value V corresponding thereto is calculated according to the cubic function formula (1-3), where $L_3$ and $L_4$ are the brightness values corresponding to the third and fourth selected gray-scale values, respectively, $V_3$ is the gray-scale voltage value corresponding to the third selected gray-scale value, and $a_{13}$, $a_{23}$, and $a_{33}$ are fitting coefficients of the cubic function formula (1-3);

the cubic function formula obtained by performing fitting on the brightness values and the gray-scale voltage values corresponding to the fourth and fifth selected gray-scale values is:

$$V=a_{14}(L-L_4)^3+a_{24}(L-L_4)^2+a_{34}(L-L_4)+V_4 \quad (1\text{-}4)$$

as for the brightness value L in the range of $[L_4, L_5]$, the gray-scale voltage value V corresponding thereto is calculated according to the cubic function formula (1-4), where $L_4$ and $L_5$ are the brightness values corresponding to the fourth and fifth selected gray-scale values, respectively, $V_4$ is the gray-scale voltage value corresponding to the fourth selected gray-scale value, and $a_{14}$, $a_{24}$ and $a_{34}$ are fitting coefficients of the cubic function formula (1-4);

the cubic function formula obtained by performing fitting on the brightness values and the gray-scale voltage values corresponding to the fifth and sixth selected gray-scale values is:

$$V=a_{15}(L-L_5)^3+a_{25}(L-L_5)^2+a_{35}(L-L_5)+V_5 \quad (1\text{-}5)$$

as for the brightness value L in the range of $[L_5, L_6]$, the gray-scale voltage value V corresponding thereto is calculated according to the cubic function formula (1-5), where $L_5$ and $L_6$ are the brightness values corresponding to the fifth and sixth selected gray-scale values, respectively, $V_5$ is the gray-scale voltage value corresponding to the fifth selected gray-scale value, and $a_{15}$, $a_{25}$ and $a_{35}$ are fitting coefficients of the cubic function formula (1-5):

the cubic function formula obtained by performing fitting on the brightness values and the gray-scale voltage values corresponding to the sixth and seventh selected gray-scale values is:

$$V=a_{16}(L-L_6)^3+a_{26}(L-L_6)^2+a_{36}(L-L_6)+V_6 \quad (1\text{-}6)$$

as for the brightness value L in the range of $[L_6, L_7]$, the gray-scale voltage value V corresponding thereto is calculated according to the cubic function formula (1-6), where $L_6$ and $L_7$ are the brightness values corresponding to the sixth and seventh selected gray-scale values, respectively, $V_6$ is the gray-scale voltage value corresponding to the sixth selected gray-scale value, and $a_{16}$, $a_{26}$ and $a_{36}$ are fitting coefficients of the cubic function formula (1-6):

the cubic function formula obtained by performing fitting on the brightness values and the gray-scale voltage values corresponding to the seventh and eighth selected gray-scale values is:

$$V=a_{17}(L-L_7)^3+a_{27}(L-L_7)^2+a_{37}(L-L_7)+V_7 \quad (1\text{-}7)$$

as for the brightness value L in the range of $[L_7, L_8]$, the gray-scale voltage value V corresponding thereto is calculated according to the cubic function formula (1-7), where $L_7$ and $L_8$ are the brightness values corresponding to the seventh and eighth selected gray-scale values, respectively, $V_7$ is the gray-scale voltage value corresponding to the seventh selected gray-scale value, and $a_{17}$, $a_{27}$ and $a_{37}$ are fitting coefficients of cubic function the formula (1-7); and the cubic function formula obtained by performing fitting on the brightness values and the gray-scale voltage values corresponding to the eighth and ninth selected gray-scale values is:

$$V=a_{18}(L-L_8)^3+a_{28}(L-L_8)^2+a_{38}(L-L_8)+V_8 \quad (1\text{-}8)$$

as for the brightness value L in the range of $[L_8, L_9]$, the gray-scale voltage value V corresponding thereto is calculated according to the cubic function formula (1-8), where $L_8$ and $L_9$ are the brightness values corresponding to the eighth and ninth selected gray-scale values, respectively, $V_8$ is the gray-scale voltage value corresponding to the eighth selected gray-scale value, and $a_{18}$, $a_{28}$ and $a_{38}$ are fitting coefficients of the cubic function formula (1-8).

As a second aspect of the present invention, there is provided a gamma curve adjusting device, including:

a standard brightness calculation module, used for substituting a preset maximum brightness value, a preset gamma value and gray-scale values into a standard gamma curve calculation formula, to obtain brightness values corresponding to the gray-scale values;

a gray-scale voltage measuring module, used for selecting N gray-scale values from the gray-scale values, and actually measuring, in the condition of the selected N gray-scale values, gray-scale voltage values required to reach the brightness values, respectively corresponding to the selected N gray-scale values, calculated by the standard brightness calculation module, where N is a positive integer;

a data fitting module, used for obtaining a function formula between gray-scale voltage value and brightness value according to the brightness values respectively corresponding to the selected N gray-scale values and the gray-scale voltage values actually measured by the gray-scale voltage measuring module; and a gray-scale voltage calculation module, used for calculating the gray-scale voltage values corresponding to brightness values smaller than or equal to the preset maximum brightness value, according to the function formula obtained by the data fitting module.

Optionally, wherein, the standard brightness calculation module calculates the brightness values corresponding to the gray-scale values according to the following standard gamma curve calculation formula:

$$L_{Gray} = L_{max}\left(\frac{\text{Gray}}{N_{Gray_max}}\right)^{\gamma}$$

where, $N_{gray_max}$ is the maximum gray-scale value, Gray is any gray-scale value in the range of $[0, N_{gray_max}]$, $\gamma$ is the preset gamma value, $L_{max}$ is the preset maximum brightness value, and $L_{Gray}$ is the brightness value corresponding to the gray-scale value Gray.

Optionally, the data fitting module sequentially selects two adjacent gray-scale values from the N selected gray-scale values and performs spline fitting on the brightness values and the gray-scale voltage values corresponding to the two adjacent gray-scale values, to obtain (N−1) function formulas; and the gray-scale voltage calculation module calculates the gray-scale voltage values corresponding to the brightness values between two brightness values respectively corresponding to the two adjacent gray-scale values, according to the function formula obtained by performing spline fitting on the brightness values and the gray-scale voltage values corresponding to the two adjacent gray-scale values.

Optionally, the (N−1) function formulas each are a cubic function formula, and the cubic function formula obtained by performing fitting on the brightness values and the gray-scale voltage values corresponding to the n-th selected gray-scale value and the (n+1)-th selected gray-scale value is:

$$V=a_{1n}(L-L_n)^3+a_{2n}(L-L_n)^2+a_{3n}(L-L_n)+V_n;$$

where, $n\epsilon[1, N-1]$, L is a brightness value in the range of $[L_n, L_{n+1}]$, $L_n$ is the brightness value corresponding to the n-th selected gray-scale value, $L_{n+1}$ is the brightness value corresponding to the (n+1)-th selected gray-scale value, $V_n$ is the gray-scale voltage value corresponding to the brightness value $L_n$, V is the gray-scale voltage value corresponding to the brightness value L, and $a_{1n}$, $a_{2n}$ and $a_{3n}$ are fitting coefficients; and as for the brightness value L in the range of $[L_n, L_{n+1}]$, the gray-scale voltage value V corresponding thereto is calculated by the gray-scale voltage calculation module according to the cubic function formula.

In the present disclosure, by actually measuring, in the condition of the given maximum brightness value, the gray-scale voltage values corresponding to a set of brightness values, and performing data fitting, the function formula between gray-scale voltage value and brightness value is obtained, so that the gray-scale voltage values corresponding to other brightness values smaller than or equal to the given maximum brightness value can be obtained by using the function formula. Therefore, in the preset disclosure, the time for gamma curve adjustment is significantly shortened while gray-scale voltage accuracy is ensured, and thus production efficiency is improved.

BRIEF DESCRIPTION OF THE DRAWINGS

The accompanying drawings, which serve to provide a further understanding of the present invention and constitute a part of this specification, are used for explaining the present invention together with the following specific implementations, rather than limiting the present invention.

DETAILED DESCRIPTION OF THE EMBODIMENTS

Specific embodiments of the present invention will be described in detail below in conjunction with the accompanying drawings. It should be understood that, the specific embodiments described herein are merely used for explaining and describing the present invention, rather than limiting the present invention.

Figure 1:
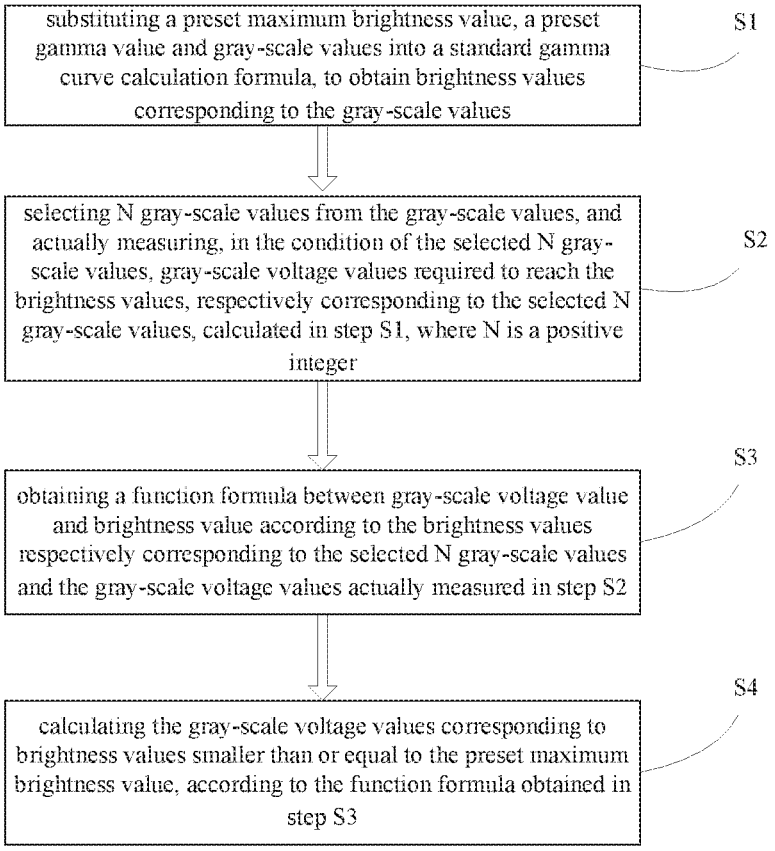
FIG. 1 is a flowchart of a gamma curve adjusting method according to embodiments of the present invention.

Embodiments of the present invention provide a gamma curve adjusting method, which, as shown in FIG. 1, includes steps of:

S1, substituting a preset maximum brightness value, a preset gamma value and gray-scale values into a standard gamma curve calculation formula, to obtain brightness values corresponding to the gray-scale values:

S2, selecting N gray-scale values from the gray-scale values, and actually measuring, in the condition of the selected N gray-scale values, gray-scale voltage values required to reach brightness values, respectively corresponding to the selected N gray-scale values, calculated in step S1, where N is a positive integer;

S3, obtaining a function formula between gray-scale voltage value and brightness value according to the brightness values respectively corresponding to the selected N gray-scale values and the gray-scale voltage values actually measured in step S2; and S4, calculating the gray-scale voltage values corresponding to brightness values smaller than or equal to the preset maximum brightness value, according to the function formula obtained in step S3.

In general, multiple groups of gamma values (for example, Gamma2, Gamma2.2, Gamma2.4, and the like) need to be set for multiple maximum brightness values (for example, 100 nit, 120 nit, 150 nit, and the like) before a display product leaves the factory, resulting in that it takes a lot of time to perform gamma curve adjustment during production, and thus it is difficult to meet the deadlines of mass production.

In the embodiments of the present invention, by actually measuring, in the condition of the given maximum brightness value, the gray-scale voltage values corresponding to a set of brightness values (i.e., the brightness values corresponding to the selected set of gray-scale values), and performing data fitting, the function formula between gray-scale voltage value and brightness value is obtained, so that the gray-scale voltage values corresponding to any brightness values smaller than or equal to the given maximum brightness value can be obtained by using the function formula. Therefore, with the gamma curve adjusting method according to the embodiments of the present invention, the time for gamma curve adjustment is significantly shortened while gray-scale voltage accuracy is ensured, and thus production efficiency is improved.

FIGS. 2*a* to 2*d* are schematic diagrams illustrating an exemplary process of adjusting a gamma curve by a gamma curve adjusting method according to embodiments of the present invention. In the example shown in FIGS. 2*a* to 2*d*, description is given by taking the case that the preset maximum brightness value is 120 nit and the preset gamma value is 2.2 as an example.

Figure 2A:
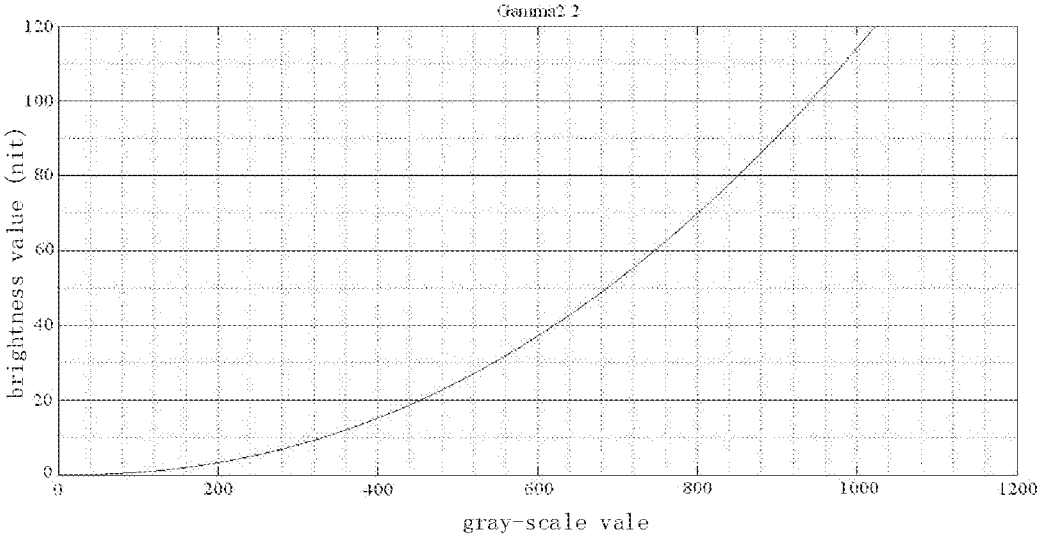
FIGS. 2*a* to 2*d* are schematic diagrams illustrating a process of adjusting a gamma curve by using a gamma curve adjusting method according to embodiments of the present invention.

FIG. 2*a* illustrates a standard gamma curve in the case that the maximum brightness value is 120 nit and the gamma value is 2.2. In step S1, brightness values corresponding to the gray-scale values can be calculated according to the standard gamma curve illustrated in FIG. 2*a*.

Figure 2B:
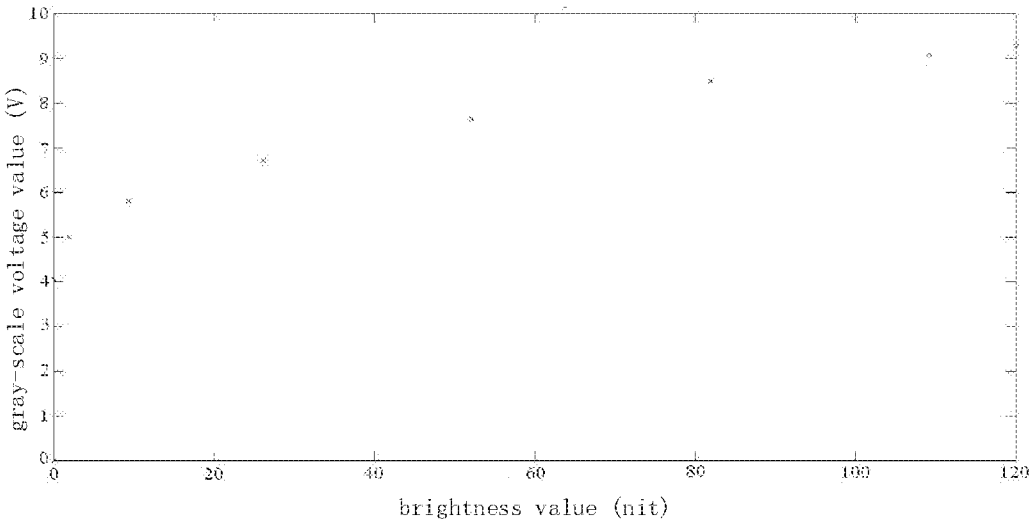

Subsequently, in step S2, a set of gray-scale values are selected from all of the gray-scale values, gray-scale voltage values required by a tested panel to reach brightness values calculated according to the standard gamma curve illustrated in FIG. 2*a* are actually measured in the condition of the selected gray-scale values, and FIG. 2*b* illustrates the brightness values and the gray-scale voltage values corresponding to the selected gray-scale values in the form of coordinate points.

Figure 2C:
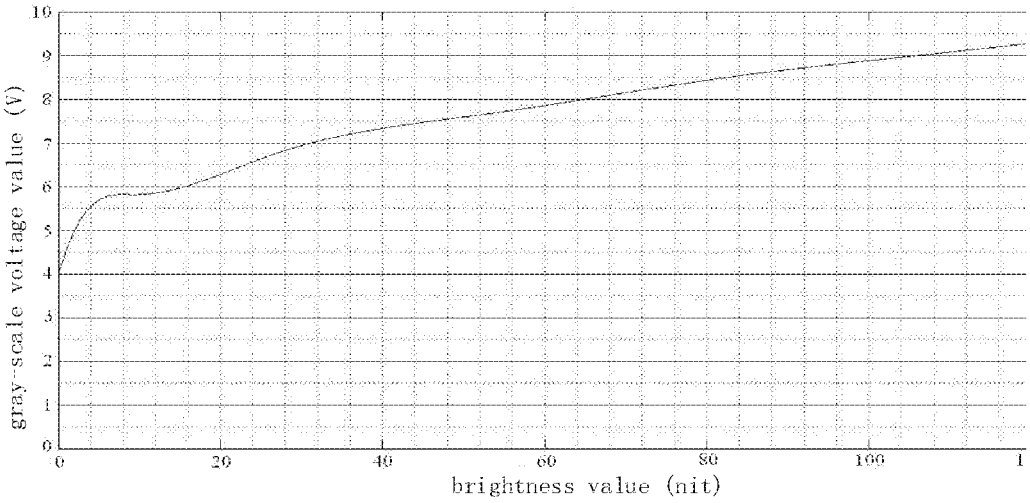
Figure 2D:
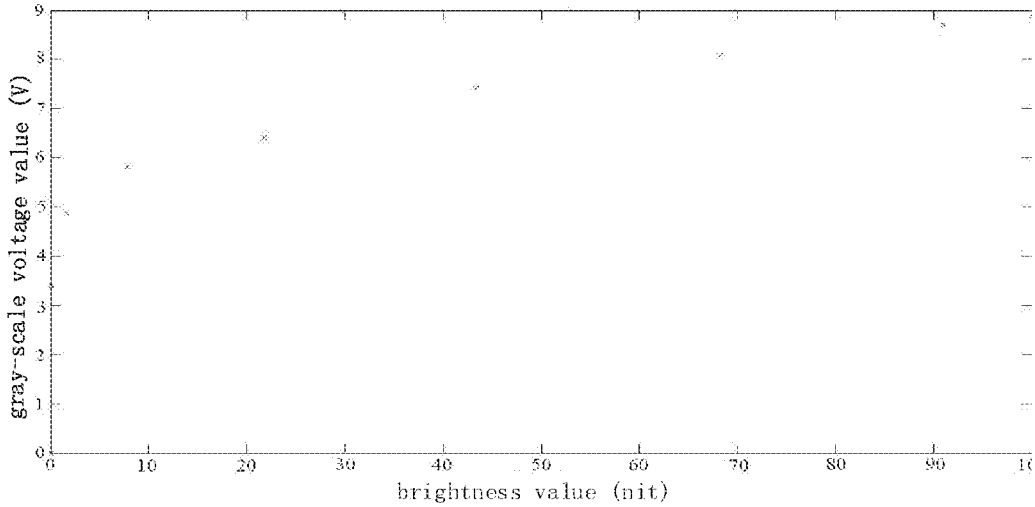

FIG. 2*c* illustrates a function curve obtained, in step S3, by performing fitting on the coordinate points in FIG. 2*b*, and the gray-scale voltage value corresponding to any brightness value smaller than or equal to 120 nit can be obtained according to the function curve in FIG. 2*c*. FIG. 2*d* is a diagram illustrating gray-scale voltage values corresponding to brightness values smaller than or equal to 100 nit obtained according to the function curve illustrated in FIG. 2*c*, in step S4.

Specifically, in step S1, the standard gamma curve calculation formula is:

$$L_{Gray} = L_{max}\left(\frac{\text{Gray}}{N_{Gray_max}}\right)^{\gamma};$$

where, $N_{gray_max}$ is the maximum gray-scale value, Gray is any gray-scale value in the range of $[0, N_{gray_max}]$, $\gamma$ is the preset gamma value, $L_{max}$ is the preset maximum brightness value, and $L_{Gray}$ is the brightness value corresponding to the gray-scale value Gray.

For example, when the total number of gray-scales is 1024, the preset maximum brightness value is 120 nit, and the present gamma value is 2.2, the maximum gray-scale value $N_{gray_max}$ is 1023, and the corresponding standard gamma curve calculation formula is:

$$L_{Gray} = 120\left(\frac{\text{Gray}}{1023}\right)^{2.2};$$

where, Gray is any gray-scale value in the range of [0, 1023].

In general, it is quite difficult to realize the above standard gamma curve exactly in a circuit, and an existing method is to select some gray-scale values (generally specified by IC spec) from the above standard gamma curve, and then to adjust the gray-scale voltages corresponding to these selected gray-scale values such that the brightness values corresponding to these selected gray-scale values reach the desired brightness values calculated according to the standard gamma curve.

In actual test, N is generally greater than or equal to 9. That is to say, the number of the selected gray-scale values is preferably greater than or equal to 9, for example, N may equal to 9, 12, 15, or the like. Within a certain range, the greater N, the higher subsequent fitting accuracy, and the better fitting effect.

According to the embodiments of the present invention, a looking up table may be created according to the selected gray-scale values, and the brightness values and the gray-scale voltage values corresponding to the selected gray-scale values. Table 1 below illustrates an example of the looking up table of nine selected gray-scale values and the brightness values and the gray-scale voltage values corresponding to the nine selected gray-scale values in the case of N=9, in which $G_1$~$G_9$ represent the selected gray-scale values, $L_1$~$L_9$ represent desired brightness values corresponding to the selected gray-scale values $G_1$~$G_9$ and calculated according to the standard gamma curve, and $V_1$~$V_9$ represent gray-scale voltage values required to reach the desired brightness values $L_1$~$L_9$ in the condition of the selected gray-scale values $G_1$~$G_9$.

TABLE I

| selected gray-scale value | $G_1$ | $G_2$ | $G_3$ | $G_4$ | $G_5$ | $G_6$ | $G_7$ | $G_8$ | $G_9$ |
|---|---|---|---|---|---|---|---|---|---|
| brightness value | $L_1$ | $L_2$ | $L_3$ | $L_4$ | $L_5$ | $L_6$ | $L_7$ | $L_8$ | $L_9$ |
| gray-scale voltage value | $V_1$ | $V_2$ | $V_3$ | $V_4$ | $V_5$ | $V_6$ | $V_7$ | $V_8$ | $V_9$ |

Further, step S3 may specifically include:

sequentially selecting two adjacent gray-scale values from the N selected gray-scale values and performing spline fitting on the brightness values and the gray-scale voltage values corresponding to the two adjacent gray-scale values, to obtain (N−1) function formulas.

As an example, data pairs ($L_1$, $V_1$) and ($L_2$, $V_2$) are selected from the data shown in Table 1 to perform spline fitting to obtain a first function formula, data pairs ($L_2$, $V_2$) and ($L_3$, $V_3$) are selected to perform spline fitting to obtain a second function formula, and so on, and finally, data pairs ($L_8$, $V_8$) and ($L_9$, $V_9$) are selected to perform spline fitting to obtain an eighth function formula.

In the embodiments of the present invention, the term "performing spline fitting" means performing fitting on two adjacent data pairs by using spline algorithm. Compared with the case where fitting is performed on multiple data pairs simultaneously to obtain one curve, sequentially performing spline fitting on two adjacent data pairs can improve fitting accuracy, and thus ensure accuracy of the gray-scale voltage adjustment to the greatest extent.

Accordingly, step S4 may specifically include:

calculating the gray-scale voltage values corresponding to the brightness values between two brightness values respectively corresponding to the two adjacent gray-scale values, according to the function formula obtained by performing spline fitting on the brightness values and the gray-scale voltage values corresponding to the selected two adjacent gray-scale values.

As an example, as for a brightness value between $L_1$ and $L_2$, the gray-scale voltage value corresponding thereto is calculated according to the first function formula obtained by performing spline fitting on the data pairs ($L_1$, $V_1$) and ($L_2$, $V_2$); as for the brightness value between $L_2$ and $L_3$, the gray-scale voltage value corresponding thereto is calculated according to the second function formula obtained by performing spline fitting on the data pairs ($L_2$, $V_2$) and ($L_3$, $V_3$), and so on.

Optionally, in step S3, the (N−1) function formulas may each be a cubic function formula, and the cubic function formula obtained by performing fitting on the brightness values and the gray-scale voltage values corresponding to the n-th selected gray-scale value and the (n+1)-th selected gray-scale value is:

$$V=a_{1n}(L-L_n)^3+a_{2n}(L-L_n)^2+a_{3n}(L-L_n)+V_n;$$

where, n∈[1, N−1], L is a brightness value in the range of $[L_n, L_{n+1}]$, $L_n$ is the brightness value corresponding to the n-th selected gray-scale value, $L_{n+1}$ is the brightness value corresponding to the (n+1)-th selected gray-scale value. $V_n$ is the gray-scale voltage value corresponding to the brightness value $L_n$, V is the gray-scale voltage value corresponding to the brightness value L, and $a_{1n}$, $a_{2n}$ and $a_{3n}$ are fitting coefficients.

Accordingly, in step S4, as for the brightness value L in the range of $[L_n, L_{n+1}]$, the gray-scale voltage value V corresponding thereto is calculated according to the above cubic function formula.

The cubic function formula obtained by fitting is explained by taking the case of N=9 as an example below.

The cubic function formula obtained by performing fitting on the brightness values and the gray-scale voltage values corresponding to the first and second selected gray-scale values is:

$$V=a_{11}(L-L_1)^3+a_{21}(L-L_1)^2+a_{31}(L-L_1)+V_1 \quad (1\text{-}1)$$

as for the brightness value L in the range of $[L_1, L_2]$, the gray-scale voltage value V corresponding thereto may be calculated according to the formula (1-1), where $L_1$ and $L_2$ are the brightness values corresponding to the first and second selected gray-scale values, respectively, $V_1$ is the gray-scale voltage value corresponding to the first selected gray-scale value, and $a_{11}$, $a_{21}$ and $a_{31}$ are fitting coefficients of the formula (1-1).

The cubic function formula obtained by performing fitting on the brightness values and the gray-scale voltage values corresponding to the second and third selected gray-scale values is:

$$V=a_{12}(L-L_2)^3+a_{22}(L-L_2)^2+a_{32}(L-L_2)+V_2 \quad (1\text{-}2)$$

as for the brightness value L in the range of $[L_2, L_3]$, the gray-scale voltage value V corresponding thereto may be calculated according to the formula (1-2), where $L_2$ and $L_3$ are the brightness values corresponding to the second and third selected gray-scale values, respectively, $V_2$ is the gray-scale voltage value corresponding to the second selected gray-scale value, and $a_{12}$, $a_{22}$ and $a_{32}$ are fitting coefficients of the formula (1-2).

The cubic function formula obtained by performing fitting on the brightness values and the gray-scale voltage values corresponding to the third and fourth selected gray-scale values is:

$$V=a_{13}(L-L_3)^3+a_{23}(L-L_3)^2+a_{33}(L-L_3)+V_3 \quad (1\text{-}3)$$

as for the brightness value L in the range of $[L_3, L_4]$, the gray-scale voltage value V corresponding thereto may be calculated according to the formula (1-3), where $L_3$ and $L_4$ are the brightness values corresponding to the third and fourth selected gray-scale values, respectively, $V_3$ is the gray-scale voltage value corresponding to the third selected gray-scale value, and $a_{13}$, $a_{23}$ and $a_{33}$ are fitting coefficients of the formula (1-3).

The cubic function formula obtained by performing fitting on the brightness values and the gray-scale voltage values corresponding to the fourth and fifth selected gray-scale values is:

$$V=a_{14}(L-L_4)^3+a_{24}(L-L_4)^2+a_{34}(L-L_4)+V_4 \quad (1\text{-}4)$$

as for the brightness value L in the range of $[L_4, L_5]$, the gray-scale voltage value V corresponding thereto may be calculated according to the formula (1-4), where $L_4$ and $L_5$ are the brightness values corresponding to the fourth and fifth selected gray-scale values, respectively, $V_4$ is the gray-scale voltage value corresponding to the fourth selected gray-scale value, and $a_{14}$, $a_{24}$ and $a_{34}$ are fitting coefficients of the formula (1-4).

The cubic function formula obtained by performing fitting on the brightness values and the gray-scale voltage values corresponding to the fifth and sixth selected gray-scale values is:

$$V=a_{15}(L-L_5)^3+a_{25}(L-L_5)^2+a_{35}(L-L_5)+V_5 \quad (1\text{-}5)$$

as for the brightness value L in the range of $[L_5, L_6]$, the gray-scale voltage value V corresponding thereto may be calculated according to the formula (1-5), where $L_5$ and $L_6$ are the brightness values corresponding to the fifth and sixth selected gray-scale values, respectively, $V_5$ is the gray-scale voltage value corresponding to the fifth selected gray-scale value, and $a_{15}$, $a_{25}$ and $a_{35}$ are fitting coefficients of the formula (1-5).

The cubic function formula obtained by performing fitting on the brightness values and the gray-scale voltage values corresponding to the sixth and seventh selected gray-scale values is:

$$V=a_{16}(L-L_6)^3+a_{26}(L-L_6)^2+a_{36}(L-L_6)+V_6 \quad (1\text{-}6)$$

as for the brightness value L in the range of $[L_6, L_7]$, the gray-scale voltage value V corresponding thereto may be calculated according to the formula (1-6), where $L_6$ and $L_7$ are the brightness values corresponding to the sixth and seventh selected gray-scale values, respectively, $V_6$ is the gray-scale voltage value corresponding to the sixth selected gray-scale value, and $a_{16}$, $a_{26}$ and $a_{36}$ are fitting coefficients of the formula (1-6).

The cubic function formula obtained by performing fitting on the brightness values and the gray-scale voltage values corresponding to the seventh and eighth selected gray-scale values is:

$$V=a_{17}(L-L_7)^3+a_{27}(L-L_7)^2+a_{37}(L-L_7)+V_7 \quad (1\text{-}7)$$

as for the brightness value L in the range of $[L_7, L_8]$, the gray-scale voltage value V corresponding thereto may be calculated according to the formula (1-7), where $L_7$ and $L_8$ are the brightness values corresponding to the seventh and eighth selected gray-scale values, respectively, $V_7$ is the gray-scale voltage value corresponding to the seventh selected gray-scale value, and $a_{17}$, $a_{27}$ and $a_{37}$ are fitting coefficients of the formula (1-7).

The cubic function formula obtained by performing fitting on the brightness values and the gray-scale voltage values corresponding to the eighth and ninth selected gray-scale values is:

$$V=a_{18}(L-L_8)^3+a_{28}(L-L_8)^2+a_{38}(L-L_8)+V_8 \quad (1\text{-}8)$$

as for the brightness value L in the range of $[L_8, L_9]$, the gray-scale voltage value V corresponding thereto may be calculated according to the formula (1-8), where $L_8$ and $L_9$ are the brightness values corresponding to the eighth and ninth selected gray-scale values, respectively, $V_8$ is the gray-scale voltage value corresponding to the eighth selected gray-scale value, and $a_{18}$, $a_{28}$ and $a_{38}$ are fitting coefficients of the formula (1-8).

According to the above eight function formulas of (1-1) to (1-8), a curvilinear relationship between all the brightness values smaller than or equal to the preset maximum brightness value (120 nit) and the gray-scale voltage values can be established for the tested panel, so that other sets of gray-scale voltages corresponding to the brightness values smaller than 120 nit can be obtained according to the above function formulas, thereby achieving the object of adjusting the gamma curve quickly.

The gamma curve adjusting method according to the embodiments of the present invention will be described in detail below by way of a specific example.

It is assumed that the preset maximum brightness value is 120 nit, the preset gamma value is 2.2, the total number of gray-scales is 1024, and the number N of the selected gray-scale values is 9. As described above, the standard gamma curve calculation formula is:

$$L_{Gray} = 120\left(\frac{\text{Gray}}{1023}\right)^{2.2}.$$

Desired brightness corresponding to nine selected gray-scale values (specifically, 0, 40, 160, 320, 512, 700, 860, 980, and 1023) are calculated according to the above standard gamma curve calculation formula, as shown in Table 2. In Table 2, G represents selected gray-scale value, and L presents brightness value in (nit).

TABLE 2

| G | 0 | 40 | 160 | 320 | 512 | 700 | 860 | 980 | 1023 |
|---|---|---|---|---|---|---|---|---|---|
| L | 0 | 0.096 | 2.21 | 9.31 | 26.17 | 52.08 | 81.91 | 109.18 | 120 |

Afterwards, in the condition of the above nine selected gray-scale values, gray-scale voltage values required by the tested panel to reach the corresponding desired brightness values in Table 2 are actually measured to obtain a looking-up table shown in Table 3. In Table 3, G represents selected gray-scale value, L represents brightness value in (nit), and V represents gray-scale voltage value in (V).

TABLE 3

| G | 0 | 40 | 160 | 320 | 512 | 700 | 860 | 980 | 1023 |
|---|---|---|---|---|---|---|---|---|---|
| L | 0 | 0.096 | 2.21 | 9.31 | 26.17 | 52.08 | 81.91 | 109.18 | 120 |
| V | 0 | 4.04 | 5.00 | 5.81 | 6.71 | 7.64 | 8.48 | 9.06 | 9.28 |

Subsequently, two adjacent pairs of (L, V) are sequentially selected to perform spline fitting thereon, so as to obtain eight specific function formulas.

As for the brightness value L in the range of [0, 0.096], the gray-scale voltage value V corresponding thereto may be obtained according to the following formula:

$$V=6.075(L-0)^3+33.433(L-0)^2+45.262(L-0)+0;$$

as for the brightness value L in the range of [0.096, 2.21], the gray-scale voltage value V corresponding thereto may be obtained according to the following formula:

$$V=6.075(L-0.096)^3+31.685(L-0.096)^2+39.015(L-0.096)+4.04;$$

as for the brightness value L in the range of [2.21, 9.31], the gray-scale voltage value V corresponding thereto may be obtained according to the following formula:

$$V=-0.186(L-2.21)^3+3.48(L-2.21)^2+15.403(L-2.21)+5.00;$$

as for the brightness value L in the range of [9.31, 26.17], the gray-scale voltage value V corresponding thereto may be obtained according to the following formula:

$$V=0.014(L-9.31)^3-0.571(L-9.31)^2+5.790(L-9.31)+5.81;$$

as for the brightness value L in the range of [26.17, 52.08], the gray-scale voltage value V corresponding thereto may be obtained according to the following formula:

$$V=-0.002(L-26.17)^3+0.121(L-26.17)^2-1.790(L-26.17)+6.71:$$

as for the brightness value L in the range of [52.08, 81.91], the gray-scale voltage value V corresponding thereto may be obtained according to the following formula:

$$V=0.000435(L-52.08)^3-0.030598(L-52.08)^2+0.553989(L-52.08)+7.64;$$

as for the brightness value L in the range of [81.91, 109.18], the gray-scale voltage value V corresponding thereto may be obtained according to the following formula:

$$V=-0.000128(L-81.91)^3+0.00832(L-81.91)^2-0.110662(L-81.91)+8.48;\text{ and}$$

as for the brightness value L in the range of [109.18, 120], the gray-scale voltage value V corresponding thereto may be obtained according to the following formula:

$$V=-0.000128(L-109.18)^3-0.00212(L-109.18)+0.058263(L-109.18)+9.06;$$

The curve represented by the above eight function formulas may refer to FIG. 2*c*.

If a gamma curve needs to be obtained for the maximum brightness value of 100 nit, one may find a solution according to the above function formulas. For example, the calculation result is shown in Table 4. In Table 4, G represents selected gray-scale value, L represents brightness value in (nit), and V represents gray-scale voltage value in (V).

TABLE 4

| G | 0 | 40 | 160 | 320 | 512 | 700 | 860 | 980 | 1023 |
|---|---|---|---|---|---|---|---|---|---|
| L | 0 | 0.08 | 1.68 | 7.76 | 21.81 | 43.40 | 68.26 | 90.99 | 100 |
| V | 0 | 3.41 | 4.87 | 5.81 | 6.40 | 7.43 | 8.10 | 8.70 | 8.88 |

FIG. 2*d* illustrates gray-scale voltage values, corresponding to the brightness values smaller than or equal to 100 nit, obtained according to the relation curve between gray-scale voltage value and brightness value in the case that the maximum brightness value is 120 nit.

Figure 3:
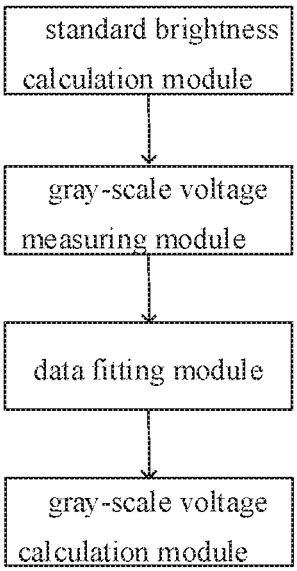
FIG. 3 is a block diagram of a gamma curve adjusting device according to embodiments of the present invention.

Embodiments of the present invention further provide a gamma curve adjusting device, which, as shown in FIG. 3, includes:

a standard brightness calculation module, used for substituting a preset maximum brightness value, a preset gamma value and gray-scale values into a standard gamma curve calculation formula, to obtain brightness values corresponding to the gray-scale values;

a gray-scale voltage measuring module, used for selecting N gray-scale values from the gray-scale values, and actually measuring, in the condition of the selected N gray-scale values, gray-scale voltage values required to reach the brightness values, respectively corresponding to the selected N gray-scale values, calculated by the standard brightness calculation module, where N is a positive integer;

a data fitting module, used for obtaining a function formula between gray-scale voltage value and brightness value according to the brightness values respectively corresponding to the selected N gray-scale values and the gray-scale voltage values actually measured by the gray-scale voltage measuring module; and a gray-scale voltage calculation module, used for calculating the gray-scale voltage values corresponding to brightness values smaller than or equal to the preset maximum brightness value, according to the function formula obtained by the data fitting module.

In the embodiments of the present invention, by actually measuring, in the condition of the given maximum brightness value, the gray-scale voltage values corresponding to a set of brightness values (i.e., the brightness values corresponding to the selected set of gray-scale values), and performing data fitting, the function formula between gray-scale voltage value and brightness value is obtained, so that the gray-scale voltage values corresponding to any brightness values smaller than or equal to the given maximum brightness value can be obtained by using the function formula. Therefore, with the gamma curve adjusting device according to the embodiments of the present invention, the time for gamma curve adjustment is significantly shortened while gray-scale voltage accuracy is ensured, and thus production efficiency is improved.

Further, the standard brightness calculation module calculates the brightness values corresponding to the gray-scale values according to the following standard gamma curve calculation formula:

$$L_{Gray} = L_{max}\left(\frac{\text{Gray}}{N_{Gray_max}}\right)^{\gamma}$$

where, $N_{gray_max}$ is the maximum gray-scale value, Gray is any gray-scale value in the range of $[0, N_{gray_max}]$, $\gamma$ is the preset gamma value, $L_{max}$ is the preset maximum brightness value, and $L_{Gray}$ is the brightness value corresponding to the gray-scale value Gray.

In general, it is quite difficult to realize the above standard gamma curve exactly in a circuit, and an existing method is to select some gray-scale values (generally specified by IC spec) from the above standard gamma curve, and then to adjust the gray-scale voltages corresponding to these selected gray-scale values such that the brightness values corresponding to these selected gray-scale values reach desired brightness values calculated according to the standard gamma curve. In actual test, N is generally greater than or equal to 9. That is to say, the number of the selected gray-scale values is preferably greater than or equal to 9, for example, N may equal to 9, 12, 15, or the like. Within a certain range, the greater N, the higher subsequent fitting accuracy and the better fitting effect.

Further, the data fitting module sequentially selects two adjacent gray-scale values from the N selected gray-scale values, and performs spline fitting on the brightness values and the gray-scale voltage values corresponding to the two adjacent gray-scale values, so as to obtain (N−1) function formulas.

Accordingly, the gray-scale voltage calculation module calculates the gray-scale voltage values corresponding to the brightness values between two brightness values respectively corresponding to the two adjacent gray-scale values, according to the function formula obtained by performing spline fitting on the brightness values and the gray-scale voltage values corresponding to the two adjacent gray-scale values.

In the embodiments of the present invention, the term "performing spline fitting" means performing fitting on two adjacent data pairs by using spline algorithm. Compared with the case where fitting is performed on multiple data pairs simultaneously to obtain one curve, sequentially performing spline fitting on two adjacent data pairs can improve fitting accuracy, and thus ensure accuracy of the gray-scale voltage adjustment to the greatest extent.

Optionally, the (N−1) function formulas may each be a cubic function formula, and the cubic function formula obtained by performing fitting on the brightness values and the gray-scale voltage values corresponding to the n-th selected gray-scale value and the (n+1)-th selected gray-scale value is:

$$V=a_{1n}(L-L_n)^3+a_{2n}(L-L_n)^2+a_{3n}(L-L_n)+V_n;$$

where, $n\in[1, N-1]$, L is a brightness value in the range of $[L_n, L_{n+1}]$, $L_n$ is the brightness value corresponding to the n-th selected gray-scale value, $L_{n+1}$ is the brightness value corresponding to the (n+1)-th selected gray-scale value, $V_n$ is the gray-scale voltage value corresponding to the brightness value $L_n$, V is the gray-scale voltage value corresponding to the brightness value L, and $a_{1n}$, $a_{2n}$ and $a_{3n}$ are fitting coefficients.

Accordingly, as for a brightness value L in the range of $[L_n, L_{n+1}]$, the gray-scale voltage value V corresponding thereto is calculated by the gray-scale voltage calculation module according to the above cubic function formula.

In conclusion, the gamma curve adjusting device according to the embodiments of the present invention can achieve quick adjustment of gamma curve, and the time for performing gamma adjusting on each display panel can be shorten during mass production, thereby saving time and improving production efficiency.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A gamma curve adjusting method, comprising steps of:

selecting N gray-scale values from all gray-scale values, where N is a positive integer;

obtaining brightness values respectively corresponding to the selected N gray-scale values according to a standard gamma curve such that each of the selected N gray-scale values and each obtained brightness value corresponding thereto satisfy the standard gamma curve, wherein the standard gamma curve has a preset maximum brightness value and a preset gamma value;

actually measuring, in the condition of the selected N gray-scale values, gray-scale voltage values required to reach the obtained brightness values respectively corresponding to the selected N gray-scale values;

obtaining a correspondence relationship between gray-scale voltage value and brightness value according to the obtained brightness values and the actually measured gray-scale voltage values; and calculating estimated gray-scale voltage values corresponding to brightness values smaller than or equal to the preset maximum brightness value, according to the obtained correspondence relationship;

wherein the gamma curve adjusting is used to adjust the gamma on a display panel.

2. The gamma curve adjusting method according to claim 1, wherein, the standard gamma curve satisfies the following formula:

$$L_{Gray} = L_{max}\left(\frac{\text{Gray}}{N_{Gray_max}}\right)^{\gamma};$$

where, $N_{Gray_max}$ is the maximum gray-scale value, Gray is any gray-scale value in the range of $[0, N_{Gray_max}]$, $\gamma$ is the preset gamma value, $L_{max}$ is the preset maximum brightness value, and $L_{Gray}$ is the brightness value corresponding to the gray-scale value Gray.

3. The gamma curve adjusting method according to claim 2, wherein, N≥9.

4. The gamma curve adjusting method according to claim 1, wherein, the step of obtaining the correspondence relationship between gray-scale voltage value and brightness value according to the obtained brightness values and the actually measured gray-scale voltage values comprises:

sequentially selecting two adjacent gray-scale values from the selected N gray-scale values and performing spline fitting on the obtained brightness values and the actually measured gray-scale voltage values corresponding to the two adjacent gray-scale values, to obtain (N−1) correspondence relationships; and the step of calculating the estimated gray-scale voltage values corresponding to brightness values smaller than or equal to the preset maximum brightness value, according to the obtained correspondence relationship comprises:

calculating the estimated gray-scale voltage values corresponding to the brightness values between two brightness values respectively corresponding to the two adjacent gray-scale values, according to the correspondence relationship obtained by performing spline fitting on the obtained brightness values and the actually measured gray-scale voltage values corresponding to the two adjacent gray-scale values.

5. The gamma curve adjusting method according to claim 4, wherein, the (N−1) correspondence relationships each satisfy a cubic function formula, and the cubic function formula obtained by performing fitting on the obtained brightness values and the actually measured gray-scale voltage values corresponding to the n-th selected gray-scale value and the (n+1)-th selected gray-scale value of the selected N gray-scale values is:

$$V=a_{1n}(L-L_n)^3+a_{2n}(L-L_n)^2+a_{3n}(L-L_n)+V_n;$$

where, $n\in[1, N-1]$, L is a brightness value in the range of $[L_n, L_{n+1}]$, $L_n$ is the brightness value corresponding to the n-th selected gray-scale value, $L_{n+1}$ is the brightness value corresponding to the (n+1)-th selected gray-scale value, $V_n$ is the gray-scale voltage value corresponding to the brightness value $L_n$, V is the gray-scale voltage value corresponding to the brightness value L, and $a_{1n}$, $a_{2n}$ and $a_{3n}$ are fitting coefficients; and as for the brightness value in the range of $[L_a, L_{n+1}]$, the estimated gray-scale voltage value corresponding thereto is calculated according to the cubic function formula.

6. The gamma curve adjusting method according to claim 5, wherein, N≥9.

7. The gamma curve adjusting method according to claim 5, wherein, N=9;

the cubic function formula obtained by performing fitting on the obtained brightness values and the actually measured gray-scale voltage values corresponding to the first and second selected gray-scale values of the selected N gray-scale values is:

$$V=a_{11}(L-L_1)^3+a_{21}(L-L_1)^2+a_{31}(L-L_1)+V_1 \quad (1\text{-}1)$$

as for the brightness value L in the range of $[L_1, L_2]$, the gray-scale voltage value V corresponding thereto is calculated according to the cubic function formula (1-1), where $L_1$ and $L_2$ are the brightness values corresponding to the first and second selected gray-scale values, respectively, $V_1$ is the gray-scale voltage value corresponding to the first selected gray-scale value, and $a_{11}$, $a_{21}$ and $a_{31}$ are fitting coefficients of the cubic function formula (1-1);

the cubic function formula obtained by performing fitting on the obtained brightness values and the actually measured gray-scale voltage values corresponding to the second and third selected gray-scale values of the selected N gray-scale values is:

$$V=a_{12}(L-L_2)^3+a_{22}(L-L)^2+a_{32}(L-L_2)+V_2 \quad (1\text{-}2)$$

as for the brightness value L in the range of $[L_2, L_3]$, the gray-scale voltage value V corresponding thereto is calculated according to the cubic function formula (1-2), where $L_2$ and $L_3$ are the brightness values corresponding to the second and third selected gray-scale values, respectively, $V_2$ is the gray-scale voltage value corresponding to the second selected gray-scale value, and $a_{12}$, $a_{22}$ and $a_{32}$ are fitting coefficients of the cubic function formula (1-2);

the cubic function formula obtained by performing fitting on the obtained brightness values and the actually measured gray-scale voltage values corresponding to the third and fourth selected gray-scale values of the selected N gray-scale values is:

$$V=a_{13}(L-L_3)^3+a_{23}(L-L_3)^2+a_{33}(L-L_3)+V_3 \quad (1\text{-}3)$$

as for the brightness value L in the range of $[L_3, L_4]$, the gray-scale voltage value V corresponding thereto is calculated according to the cubic function formula (1-3), where $L_3$ and $L_4$ are the brightness values corresponding to the third and fourth selected gray-scale values, respectively, $V_3$ is the gray-scale voltage value corresponding to the third selected gray-scale value, and $a_{13}$, $a_{23}$ and $a_{33}$ are fitting coefficients of the cubic function formula (1-3);

the cubic function formula obtained by performing fitting on the obtained brightness values and the actually measured gray-scale voltage values corresponding to the fourth and fifth selected gray-scale values of the selected N gray-scale values is:

$$V=a_{14}(L-L_4)^3+a_{24}(L-L_4)^2+a_{34}(L-L_4)+V_4 \quad (1\text{-}4)$$

as for the brightness value L in the range of $[L_4, L_5]$, the gray-scale voltage value V corresponding thereto is calculated according to the cubic function formula (1-4), where $L_4$ and $L_5$ are the brightness values corresponding to the fourth and fifth selected gray-scale values, respectively, $V_4$ is the gray-scale voltage value corresponding to the fourth selected gray-scale value, and $a_{14}$, $a_{24}$ and $a_{34}$ are fitting coefficients of the cubic function formula (1-4);

the cubic function formula obtained by performing fitting on the obtained brightness values and the actually measured gray-scale voltage values corresponding to the fifth and sixth selected gray-scale values of the selected N gray-scale values is:

$$V=a_{15}(L-L_5)^3+a_{25}(L-L_5)^2+a_{35}(L-L_5)+V_5 \quad (1\text{-}5)$$

as for the brightness value L in the range of $[L_5, L_6]$, the gray-scale voltage value V corresponding thereto is calculated according to the cubic function formula (1-5), where $L_5$ and $L_6$ are the brightness values corresponding to the fifth and sixth selected gray-scale values, respectively, $V_5$ is the gray-scale voltage value corresponding to the fifth selected gray-scale value, and $a_{15}$, $a_{25}$ and $a_{35}$ are fitting coefficients of the cubic function formula (1-5);

the cubic function formula obtained by performing fitting on the obtained brightness values and the actually measured gray-scale voltage values corresponding to the sixth and seventh selected gray-scale values of the selected N gray-scale values is:

$$V=a_{16}(L-L_6)^3+a_{26}(L-L_6)^2+a_{36}(L-L_6)+V_6 \quad (1\text{-}6)$$

as for the brightness value L in the range of $[L_6, L_7]$, the gray-scale voltage value V corresponding thereto is calculated according to the cubic function formula (1-6), where $L_6$ and $L_7$ are the brightness values corresponding to the sixth and seventh selected gray-scale values, respectively, $V_6$ is the gray-scale voltage value corresponding to the sixth selected gray-scale value, and $a_{16}$, $a_{26}$ and $a_{36}$ are fitting coefficients of the cubic function formula (1-6);

the cubic function formula obtained by performing fitting on the obtained brightness values and the actually measured gray-scale voltage values corresponding to the seventh and eighth selected gray-scale values of the selected N gray-scale values is:

$$V=a_{17}(L-L_7)^3+a_{27}(L-L_7)^2+a_{37}(L-L_7)+V_7 \quad (1\text{-}7)$$

as for the brightness value L in the range of $[L_7, L_8]$, the gray-scale voltage value V corresponding thereto is calculated according to the cubic function formula (1-7), where $L_7$ and $L_8$ are the brightness values corresponding to the seventh and eighth selected gray-scale values, respectively, $V_7$ is the gray-scale voltage value corresponding to the seventh selected gray-scale value, and $a_{17}$, $a_{27}$ and $a_{37}$ are fitting coefficients of cubic function the formula (1-7); and the cubic function formula obtained by performing fitting on the obtained brightness values and the actually measured gray-scale voltage values corresponding to the eighth and ninth selected gray-scale values of the selected N gray-scale values is:

$$V=a_{18}(L-L_8)^3+a_{28}(L-L_8)^2+a_{38}(L-L_8)+V_8 \quad (1\text{-}8)$$

as for the brightness value L in the range of $[L_8, L_9]$, the gray-scale voltage value V corresponding thereto is calculated according to the cubic function formula (1-8), where $L_8$ and $L_9$ are the brightness values corresponding to the eighth and ninth selected gray-scale values, respectively, $V_8$ is the gray-scale voltage value corresponding to the eighth selected gray-scale value, and $a_{18}$, $a_{28}$ and $a_{38}$ are fitting coefficients of the cubic function formula (1-8).

8. The gamma curve adjusting method according to claim 4, wherein, N≥9.

9. The gamma curve adjusting method according to claim 1, wherein, N≥9.

* * * * *